United States Patent [19]

D'Amico

[11] 3,963,219

[45] June 15, 1976

[54] FENCE

[76] Inventor: Anthony J. D'Amico, 10390 NW. 36th St., Coral Springs, Fla. 33065

[22] Filed: Apr. 30, 1974

[21] Appl. No.: 465,693

[52] U.S. Cl. ..... 256/24; 256/37; 256/73

[51] Int. Cl.[2] ..... E04H 17/14

[58] Field of Search ..... 256/19, 21, 22, 24, 256/59, 65, 73

[56] References Cited

UNITED STATES PATENTS

| | | | |
|---|---|---|---|
| 805,764 | 11/1905 | Wheelock et al. | 256/37 |
| 1,188,171 | 6/1916 | Hanger | 256/37 |
| 2,118,032 | 5/1938 | Gibson | 256/24 UX |
| 2,906,506 | 9/1959 | Barnes et al. | 256/19 |
| 2,927,779 | 3/1960 | Umberger | 256/19 |
| 3,254,490 | 6/1966 | Moore | 256/24 X |
| 3,491,984 | 1/1970 | Nyberg | 256/65 X |
| 3,799,506 | 3/1974 | Schwartz | 256/37 X |

FOREIGN PATENTS OR APPLICATIONS

| | | | |
|---|---|---|---|
| 1,054,087 | 1/1967 | United Kingdom | 256/19 |
| 1,155,090 | 6/1969 | United Kingdom | 256/59 |

*Primary Examiner*—Dennis L. Taylor
*Attorney, Agent, or Firm*—Malin & Haley

[57] ABSTRACT

An improved fence of aluminum, sheet metal or other resilient material construction requiring reduced construction time and reduced maintenance time while providing a rigid barrier which permits ventilation therethrough. The fence is constructed preferably of aluminum or enamelized sheet metal, the fence panels being unitary and continuous from terminal end posts of the fence, the fence having a plurality of intermediate supporting posts disposed between its ends, the intermediate posts having parallel, lateral side slots sized to receive and rigidly and firmly support the continuous panels therethrough, the posts being firmly anchored in the earth. The fence terminal posts also provide for the panels to be stretched, wrapped around, and fixed to the terminal posts providing a rigid terminal connection for the panels with reduced construction time.

2 Claims, 8 Drawing Figures

FENCE

BACKGROUND OF THE INVENTION

This invention relates generally to outdoor barriers, and specifically to an improved fence which reduces construction time without sacrificing ragidity, ventilation or visual obstruction. In the past, exterior fences to obstruct an observer's view into a yard or the like while providing ventilation have been constructed of various materials such as wood in which separate panels were affixed between individual posts, thus requiring a large amount of time to affix each panel to each individual post with fasteners, nails or the like. Also, fences constructed from wooden materials require periodic maintenance to preserve the surface of the fence. Applicant's improved fence eliminates the fastening time of the panels by providing a plurality of continuous unitary flexible panels which are fixed to terminal posts, the intermediate supporting posts requiring no fastenings, such as screws, nails or the like to affix the panels thereto. The intermediate support fence posts are provided on opposite lateral sides with pairs of slots lying in the same plane which receive the flexible continous panels which are threaded therethrough, the intermediate posts being spaced apart as desired. For increased rigidity, rail sections may be fixed along the upper vertical ends of each of the intermediate and terminal posts. The flexible panels are fixed to the terminal posts at each end by threading the flexible panel ends having cut-away portions through slots in the terminal post and fastening each end about a segment of the terminal post circumference. The lower section of each of the supporting and terminal posts have lateral wall slots which receive fluent concrete when the post is embedded and anchored in concrete which hardens through the slots, increasing the rigidity of the fence post anchorage.

Applicant's improved fence provides the advantages of having a lightweight fence that is very sturdy, which eliminates the dangers of a barbed fence top and which may be constructed as a "do-it-yourself" project by a home owner or the like and utilizes construction elements of pre-cut design for the posts, allowing one to construct the fence as high or as low as desired for the particular type of privacy required. The fence is especially adapted for areas near or surrounding salt water because of its corrosion resistant qualities.

BRIEF DESCRIPTION OF THE INVENTION

An improved fence having a plurality of rigid, tubular posts, each of said posts having a plurality of parallel slots oppositely disposed on lateral sides with opposing pairs of slots lying in the same plane, said post slots being angularly disposed relative to the longitudinal axis of said tubular posts, each of said posts being disposed and affixed into the earth substantially vertically in a parallel arrangement, a plurality of unitary, continuous flexible panels, said flexible panels coupled at each end to said terminal posts, said panels being threaded through said intermediate post lateral wall slots. The tubular fence posts are anchored in the earth, such as in a bed of concrete or the like. Each post includes lateral wall slots adjacent the base end that is anchored in the earth which receives concrete allowing the concrete to flow inside the tubular member providing a concrete anchor from the inside to the outside of the tubular member as it is affixed in the earth. The fence post lateral wall slots are disposed on opposite side walls of the fence posts with opposing wall slots aligned in the desired plane on each panel. The wall slots may be obliquely disposed relative to the longitudinal axis of each post and overlapped so that when the panels are threaded through the wall slots and affixed to the ends of the terminal posts, the panels are spaced apart but horizontally overlap to prevent visual observation through the panels allowing for air flow between the panels, the panels substantially lying in parallel planes. Each flexible panel has a cut-away end which is connected at each end to a terminal post by stretching and threading through terminal post slots and then wrapping the end section about a portion of the exterior circumference of the terminal post and affixed rigidly thereto by screws of the like.

The fence may be constructed of aluminum sheet material which is anodized to prevent corrosion or from a sheet metal which has an enameled or corrosion resistant coating to reduce maintenance. For increased rigidity, a continuous aluminum or metal rail may be fixed along the top ends of each of the fence posts.

The top rail horizontally disposed has a plurality of slots which receive the upper end of the posts, thus rigidly connecting the vertical posts to the top rail. Additional screws or other fastening devices may be connected between the top rail and the vertical fence posts for additional rigidity. The top rail thus provides a smooth top surface which is not hazardous to anyone who contacts the top rail of the fence.

Thus, Applicant's fence may be easily constructed by rigidly fixing the fence posts in the earth, spaced apart, and threading continuous panels through the slotted portions horizontally between said intermediate fence posts and then fixing each of the panels at the terminal fence post ends by stretching the flexible material and fixing it rigidly to the terminal posts.

It is an object of this invention to provide an improved aluminum or metallic fence which reduces construction and maintenance time.

And yet still another object of this invention is to provide an improved, durable fence requiring reduced construction time having continuous panels stretched between terminal posts, supported rigidly therebetween by tubular fence posts anchored firmly in the earth.

And yet another object of this invention is to provide an improved fence terminal post connector.

In accordance with these and other objects which will be apparent hereinafter, the instant invention will now be described with particular reference to the accompanying drawings.

PREFERRED EMBODIMENT OF THE INVENTION

Figure 1:
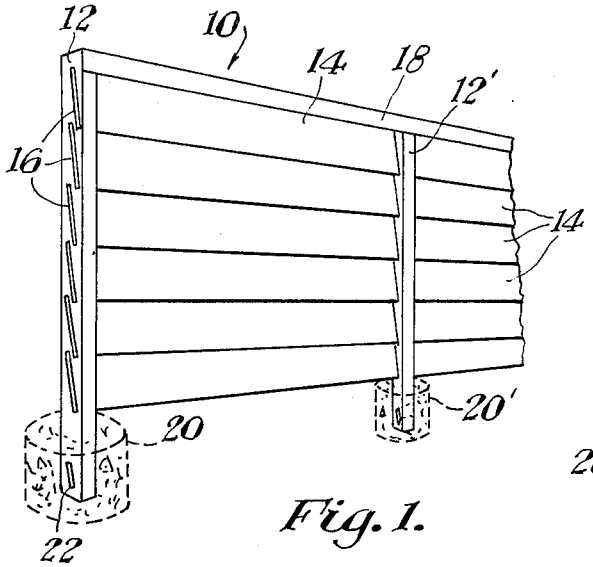
FIG. 1 shows the intermediate fence posts and continuous panels threaded therethrough in perspective showing Applicant's invention.

Referring now to the drawings and especially FIG. 1, a typical intermediate portion of Applicant's improved fence is shown comprised of a pair of vertically oriented, square, tubular fence posts 12 and 12' firmly anchored in the earth by concrete beds 20 and 20'. A plurality of unitary, continuous aluminum panels 14 are disposed horizontally and connected between the vertical support posts 12 and 12' by threading each horizontal panel through fence post slots 16. The slots 16 are parallely disposed in the same plane on opposite lateral faces of the tubular fence support post 12, the slots being sized to receive each panel 14 to hold it firmly in position and support it rigidly by the vertical posts 12 and 12'. Because of the flexible nature of the aluminum panel (which may also be sheet) metal or other plastic flexible material), the panels may be easily threaded through the lateral wall slots 16 in each post and then stretched between terminal points which will be discussed below. The planes of panels 14 and the wall slots 16, as shown in FIG. 1, are disposed at a slight angle to the vertical, longitudinal axis of the fence posts and are overlapped to obstruct the view of one standing adjacent the barrier while providing a space between each panel to permit air flow therethrough, thereby insuring ventilation. For additional strength, an upper metal rail 18 is connected at the upper vertical ends of each of the fence posts supported therebetween. The connection of the upper rail is described below.

Figure 2:
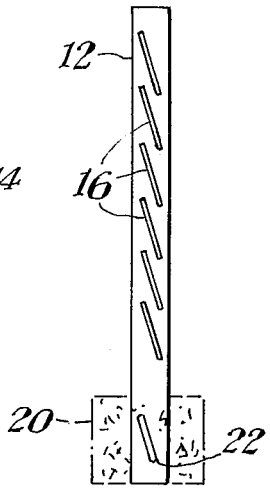
FIG. 2 is a side elevational view of an intermediate fence post as utilized in Applicant's invention.

FIG. 2 shows the fence post 12 with the obliquely oriented vertical slots 16 which receive the planar sheets of the panels. Also shown is a lateral wall slot 22 disposed adjacent the lower base end of the vertical support 12 which is received into a concrete bed for rigidly supporting the fence post in a vertical position. The slotted portions 22 allow the concrete in its fluent form to flow into both sides of the fence posts to the hollow interior to provide additional rigidity once the concrete hardens.

Figure 3:
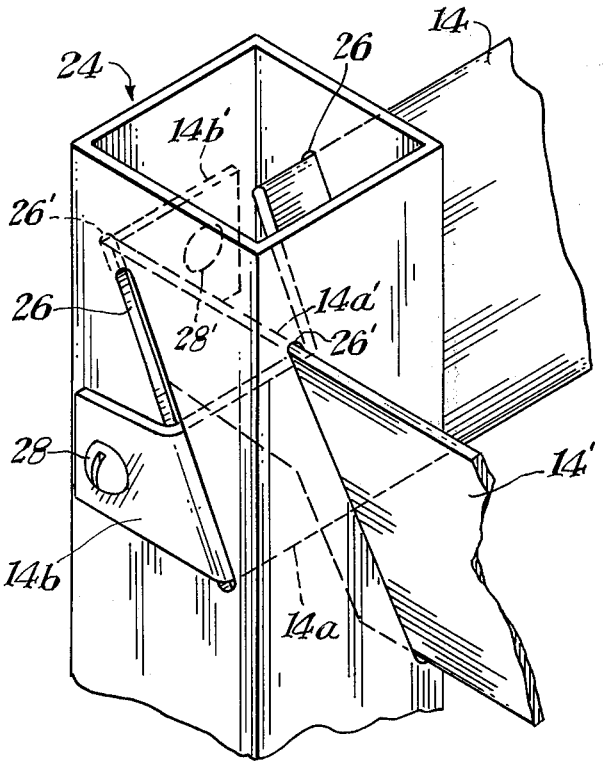
FIG. 3 is the upper terminal post shown in perspective including two of the fence panels showing the coupling of the fence panel to the terminal post at a corner in accordance with Applicant's invention.

FIG. 3 shows a terminal corner fence post connection having a terminal post 24 with pairs of slots 26 oppositely disposed in lateral faces and slots 26' in a plane approximately 90° to the plane of slots 26. The purpose of this connection is to provide in the terminal post an end connector which forms substantially a 90° corner terminal post for a fence in accordance with Applicant's invention. The panel 14 is received through the lateral side slot 26 with the end portion of the panel 14 having a cut-away tab 14A leaving a tabular portion 14B which is received through the slot 26 on the opposite lateral wall of the terminal post 14 and is wrapped about an exterior portion and anchored to the terminal post by a screw 28 or other similar fastening device. Proceeding in on the opposite terminal post wall at a 90° angle to panel 14 is another panel 14' which has a lower portion that is cut-away upper tab 14A' which is received through the terminal post and brought out through the opposite side slot 26' where it is likewise terminated in tabbed portion 14B' and fixed to the terminal post 24 by a screw fastener 28' or the like. Thus, within the corner terminal post, each of the panels 14 and 14' have continuous tabbed sections which are mated to allow the entire panel to be anchored within and to the outside surface of the terminal post 24 in a cross-over fashion allowing the panels to be stretched and anchored firmly thereto to the terminal post. This terminal pattern is repeated for all of the panels that are received and anchored through the corner terminal post.

Figure 3A:
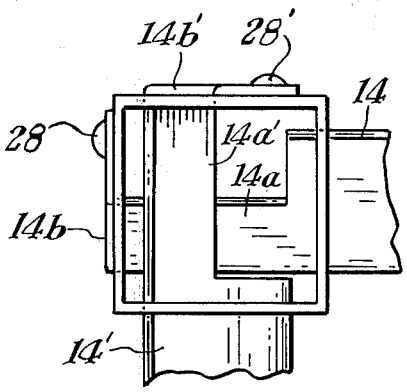
FIG. 3A is a top plan view of the upper terminal post as shown in FIG. 3.

FIG. 3A shows a top plan view showing tab portions 14A and 14A' as they are received through the terminal post and are stretched by a tabular portion 14B and 14B' and connected to the terminal post by fasteners 28 and 28'. Thus, the cut-away portions of the panel allow for the panels to be received through the terminal post and are mated in upper and lower tabs to achieve a rigid terminal connection with the post.

Referring back to FIG. 2, the slots 16 disposed in the opposite lateral faces of fence post 12 which in the preferred embodiment is shown as a rectangular aluminum tubular bar are disposed at a slight angle relative to the longitudinal axes of post 12 and slightly overlapped and spaced apart with each of the slots lying in parallel planes with spacing in between to allow air flow between the panel members. By overlapping the panels visual observation through the barrier is prevented.

Figure 4:
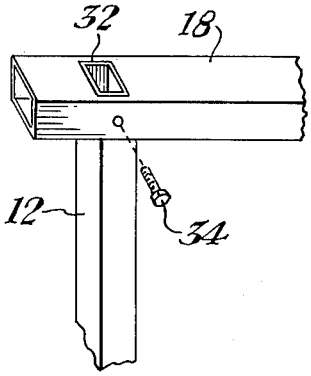
FIG. 4 is a fragmentary perspective view of the top rail connection utilized in Applicant's invention.

FIG. 4 shows a connection of the top rail 18 with slot 32 received over the top circumference of the vertical fence post 12. Additional fasteners such as a screw 34 may be used to rigidly connect the vertical fence post 12 to the top rail 18.

Figure 5A:
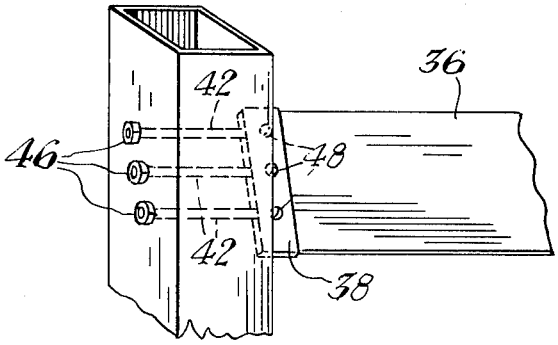
FIG. 5A shows a perspective view partially in phantom of an alternate embodiment for connecting a fence panel through the terminal post.

FIG. 5A shows an alternate embodiment terminal post connection with a panel 36 having an end connector 38 coupled to panel 36 by fasteners 48, the end connector 38 having a plurality of parallely disposed threadable connectors 42 received through holes or apertures in the terminal post and anchored to the terminal post by nuts 46 received on the threaded members 42 which allow the panel 36 to be stretched and tightened in a terminal connection.

Figure 5B:
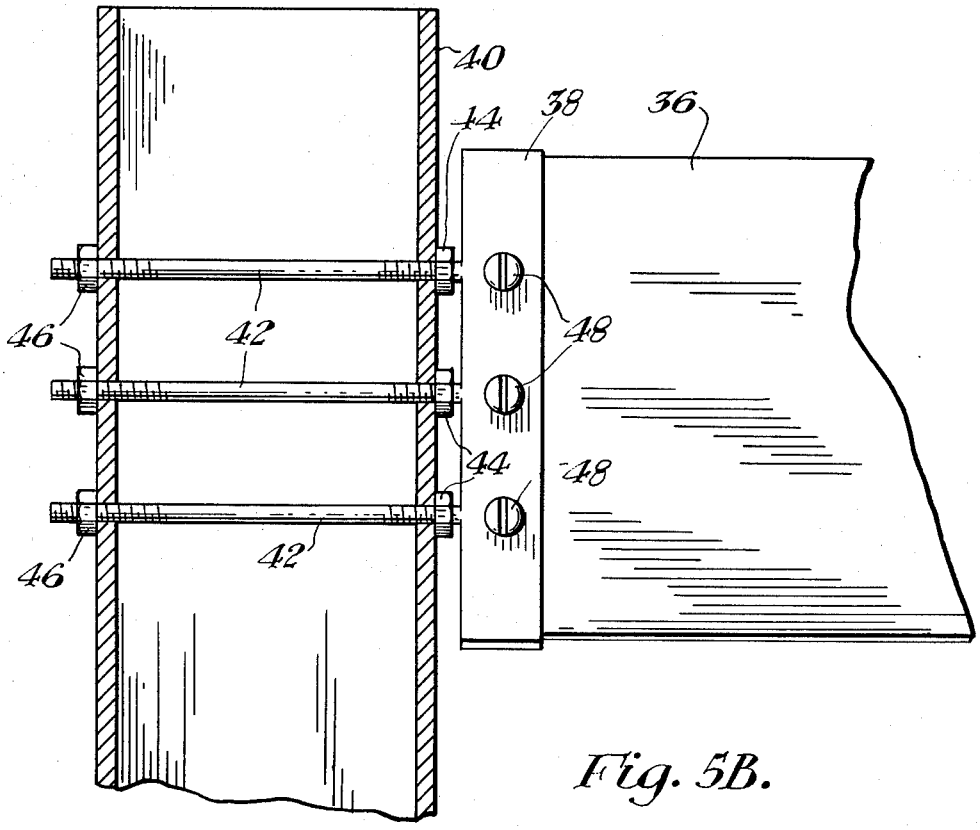
FIG. 5B shows the alternate embodiment of FIG. 5A of Applicant's invention partially in cross-section in a front elevational view.

FIG. 5B shows the embodiment of FIG. 5A in which additional nuts 44 may be disposed on the threaded connectors 42 to allow for a rigid tightening and stretching of the panel to the terminal post 40.

Figure 6:
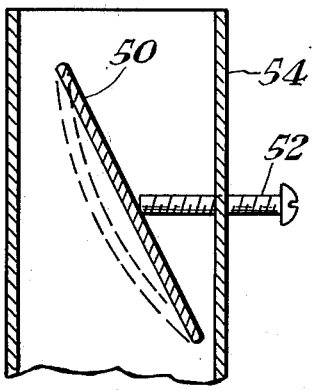
FIG. 6 shows a side elevational view of a panel tensioning means which may be utilized with Applicant's invention.

FIG. 6 shows an additional tensioning means to tighten the panels comprising a screw 52 received into the post 54 which contacts a panel 50 near its mid-section which by tightening the screw 52 forces panel 52 to be slightly deformed, thus providing additional tension along the fence panel if necessary.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A fence comprising:

a plurality of rigid, intermediate vertically oriented aluminum support members, said support members being tubular in construction and having a plurality of obliquely oriented oppositely disposed on each face parallel to slotted portions on opposite side walls, said slotted portions lying in the same plane between adjacent vertical intermediate support members;

a plurality of relatively long, continuous aluminum, relatively thin flexible panels said panels being threaded and disposed through the slotted portions in the same plane of the intermediate vertical support members; and at least two terminal vertical supports, and a means for coupling said flexible panels to said terminal vertically supports having a plurality of oblique slotted parallel side wall portions for receiving said panels therethrough;

said flexible panel end has a cut-away portion forming a tab which is received through and wrapped about one of said terminal posts, and a fastening means for coupling said tabbed end portion of said flexible panel to said terminal vertical support member.

2. A fence, as in claim 1, including:

means coupled to at least one of said vertical support members for contacting said panel disposed therebetween for tensioning said panel.

* * * * *